US006862906B2

(12) United States Patent
Lindkjølen

(10) Patent No.: US 6,862,906 B2
(45) Date of Patent: Mar. 8, 2005

(54) DEVICE FOR LOCKING GOLF CLUBS IN A GOLF BAG

(76) Inventor: Dan Lindkjølen, Tollumløkka 14 A, 3611 Kongsberg (NO)

( * ) Notice: Subject to any disclaimer, the term of this patent is extended or adjusted under 35 U.S.C. 154(b) by 0 days.

(21) Appl. No.: 10/783,590

(22) Filed: Feb. 19, 2004

(65) Prior Publication Data

US 2004/0159132 A1 Aug. 19, 2004

Related U.S. Application Data

(63) Continuation of application No. 10/227,624, filed on Aug. 22, 2002, now abandoned.

(30) Foreign Application Priority Data

Nov. 9, 2001 (NO) ..... 2001 5495

(51) Int. Cl.[7] ..... E05B 69/00

(52) U.S. Cl. ..... 70/58; 70/14; 70/19; 211/70.2; 206/315.2

(58) Field of Search ..... 70/14, 18, 19, 70/57, 58, 232, 30, 49, 61, 62; 211/70.2, 4, 8, 70–70.8, 60.1, 62, 68; 206/315.2, 315.6; 59/78, 84, 93

(56) References Cited

U.S. PATENT DOCUMENTS 350,523 A * 10/1886 Bodley
546,231 A * 9/1895 Fronefield et al.
1,204,813 A * 11/1916 Murray
1,719,360 A * 7/1929 Deike
2,128,804 A * 8/1938 Donaldson ..... 59/78 X
2,588,110 A * 3/1952 Halliday ..... 211/4
3,144,748 A * 8/1964 Knop ..... 59/78 X
3,603,078 A * 9/1971 Schweibert ..... 59/84 X
3,985,229 A * 10/1976 Maki ..... 206/315.2 X
4,753,446 A * 6/1988 Mills ..... 206/315.6 X
4,863,019 A * 9/1989 Lewis et al. ..... 206/315.3
5,004,100 A * 4/1991 Smith ..... 206/315.2
5,029,703 A * 7/1991 Dulyea, Sr. ..... 206/315.3
5,524,753 A * 6/1996 Murphy ..... 206/315.6
5,582,042 A * 12/1996 Mordick ..... 70/14
5,610,585 A * 3/1997 Jobe ..... 206/315.3 X
5,918,490 A * 7/1999 Lion ..... 70/58
6,050,405 A 4/2000 Rossi et al. ..... 206/315.2
6,062,050 A * 5/2000 Lion ..... 70/58
6,092,402 A * 7/2000 Porcelli et al. ..... 70/18
6,112,895 A * 9/2000 Ryan ..... 206/315.6
6,142,319 A * 11/2000 Kim ..... 211/70.2
6,196,385 B1 * 3/2001 Thompson et al. ..... 206/315.6
6,381,998 B1 * 5/2002 Good ..... 70/58

* cited by examiner

*Primary Examiner*—Suzanne Dino Barrett
(74) *Attorney, Agent, or Firm*—Sierra Patent Group, Ltd.

(57) ABSTRACT

A locking device for locking golf clubs in a golf bag and the like, comprising a continuous chain of hinged links, where the links are formed so that two adjacent links in a first mutual position enclose the golf club shaft so as to prevent the golf club from being taken out of engagement with the links, while the links in a second mutual position partly enclose the shaft of the golf club, allowing the golf club to be removed.

17 Claims, 4 Drawing Sheets

DEVICE FOR LOCKING GOLF CLUBS IN A GOLF BAG

PRIOR APPLICATIONS

This application is a continuation of U.S. application Ser. No. 10/227,624 filed on Aug. 22, 2002 (now abandoned), which claims priority to Norway application number 2001 5495, filed on Nov. 9, 2001.

BACKGROUND

The present invention regards a device for securing golf clubs, preferably in golf bags.

The theft of golf clubs from golf bags has become a serious problem. Both single clubs and entire bags and their contents get stolen, especially when the bags are left unattended outside the club house. As a result, recent years have seen the development of several devices that wholly or in part prevent the theft of golf clubs from golf bags, and also entire golf bags.

SE 462 582 describes a device for locking golf clubs in a golf bag, comprising a plate having slits matched to the golf club shafts. A bow closure is adapted for closing the open end of the slit, thereby preventing the removal of the golf clubs from the bag.

From U.S. Pat. No. 5,524,753 there is known a locking device comprising two plates on top of each other having elongated cutouts. The cutouts are wide enough for the shaft of the golf club to be put through the cutouts. The plates may then be displaced relative to each other and locked in a position in which the golf club can not be pulled out again.

Common to all these solutions is the fact that they are relatively complicated and involve a large number of mechanical components, they weight quite a lot, remain part of the golf bag, and have so far not been a success in the market due to said facts.

SUMMARY

Thus an object of the present invention is to provide a locking device for golf clubs, whereby the problems associated with previous solutions are avoided. It is furthermore an object to solve the problem of theft of golf clubs in a manner that is satisfactory to the golf player, so that the locking device may easily be put on and removed from the clubs, that it is lightweight, and that it can be easily be removed from the actual golf bag with one simple grip.

This object is achieved in accordance with the present invention by a locking device for locking golf clubs in a golf bag or similar, comprising a continuous chain of hinged links, where the links are constructed so that two adjacent links in a first mutual position may enclose the shaft of a golf club in a manner so as to prevent it from being taken out of engagement with the links, while the links in a second mutual position partly enclose the shaft of the golf club, so as to allow the golf club to be removed.

Preferably, the chain of hinged links can form a closed ring when all the links are in the first mutual position relative to their adjacent links.

Preferably also, the chain may be locked together as a closed ring.

According to a preferred embodiment, at least one of the interconnected links is formed with a cutout that is open to the outside of the of the link in order to receive the shaft of the golf club, where the other link closes the opening of the cutout towards the outside when the links are in the first mutual position, and does not close the opening of the cutout towards the outside when the links are in the second mutual position.

It is preferable for the two interconnected links to be constructed with cutouts that are open to the outside of the link in order to receive the shaft of the golf club, the cutouts together forming a hole in which the shaft of the golf club can be accommodated when the links are in their first mutual position, and the cutouts in adjacent links overlapping to allow the golf club to be removed from the cutout when the links are in their second mutual position.

Preferably, two adjacent links are inter-rotatable about an axis substantially coincident with the longitudinal axis of the shaft of a golf club placed in the cutout.

It is preferable that grooves in the shape of a sector of a circle be provided on each link, where the center of the sector in the main coincides with the axis, and where the sector shaped grooves engage projections on the adjacent link.

The present locking device is flexible both with regard to the furnishing of the bag and the number of golf clubs in the bag.

The disclosed device is directed toward a locking device for locking golf clubs in a golf bag. The locking device comprises a first link including a body having a front and a rear opposite the front. The body defines a first link front cutout having a semicircular pattern configured to match a golf club shaft and a first link rear cutout having a semicircular pattern configured to match the golf club shaft. The first link body has a first link forked portion and a first link flat portion. The first link flat portion is formed by a first arm proximate the front. The first link forked portion has a second arm and a third arm opposite the second arm forming a first link spacing proximate the rear. The first link includes a pair of first link grooves formed in the first link body proximate the first link front cutout and the rear cutout. The first link includes a set of first link projections proximate the front and the rear. A second link includes a body having a front and a rear opposite the front. The body defines a second link front cutout having a semicircular pattern configured to match the golf club shaft and a second link rear cutout having a semicircular pattern configured to match the golf club shaft. The second link body has a second link forked portion and a second link flat portion. The second link flat portion is formed by a first arm proximate the front. The second link forked portion has a second arm and a third arm opposite the second arm forming a second link spacing proximate the rear. The second link includes a pair of second link grooves formed in the second link body proximate the second link front cutout and the rear cutout. The second link includes a set of second link projections proximate the front and the rear. The first link and the second link are configured to enclose the golf shaft between the first link rear cutout and the second link front cutout. The second link flat portion is configured to insert into the first link spacing and a first link rear projection is configured to slidably dispose in a second link front groove. A second link front projection is configured to slidably dispose in a first link rear groove.

In another embodiment, the disclosed device is directed toward a locking device for locking golf clubs in a golf bag comprising a first link including a body having a front and a rear opposite the front. The body defines a first link front cutout having a semicircular pattern configured to match a golf club shaft and a first link rear cutout having a semicircular pattern configured to match the golf club shaft. The first link body has a first link front flat portion and a first link rear flat portion. The first link front flat portion is formed by a first arm proximate the front. The first link rear flat portion is formed by a second arm proximate the rear. The first link front flat portion and the first link rear flat portion are non-planar. The first link includes a pair of first link grooves formed in the first link body proximate the first link front cutout and the first link rear cutout. The first link includes a set of first link projections proximate the front and the rear. A second link includes a body having a front and a rear opposite the front. The body defines a second link front cutout having a semicircular pattern configured to match a golf club shaft and a second link rear cutout having a semicircular pattern configured to match the golf club shaft. The second link body has a second link front flat portion and a second link rear flat portion. The second link front flat portion is formed by a first arm proximate the front. The second link rear flat portion is formed by a second arm proximate the rear. The second link front flat portion and second first link rear flat portion are non-planar. The second link includes a pair of second link grooves formed in the second link body proximate the second link front cutout and the second link rear cutout. The second link includes a set of second link projections proximate the front and the rear. The first link and the second link are configured to enclose the golf shaft between the first link rear cutout and the second link front cutout. The second link front flat portion is configured to couple with the first link rear flat portion and a first link rear projection configured to slidably dispose in a second link front groove. A second link front projection is configured to slidably dispose in a first link rear groove.

BRIEF DESCRIPTION OF THE DRAWINGS

The present invention will be described below with reference to a preferred embodiment and the accompanying figures, in which.

DETAILED DESCRIPTION

Figure 1:
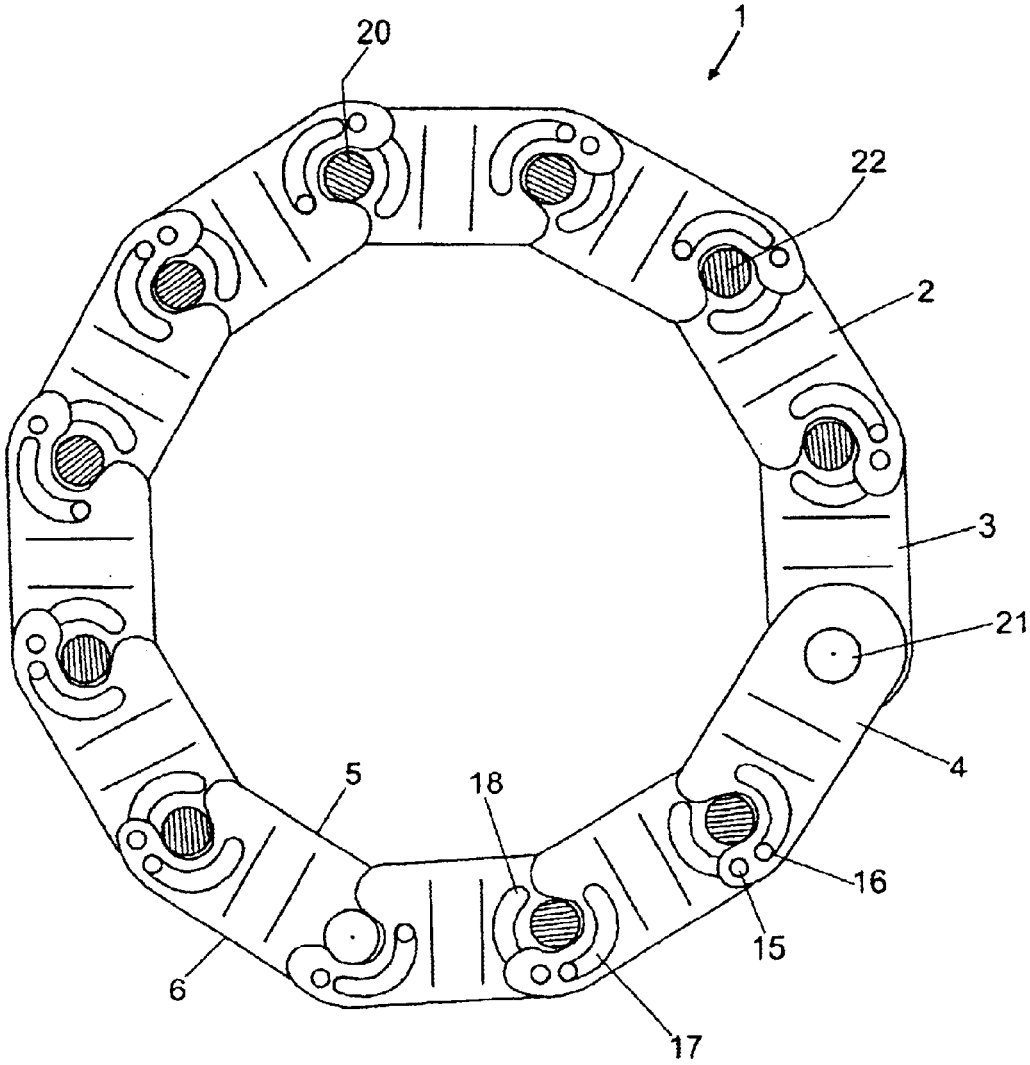
FIG. 1 is a top view of a preferred embodiment of the present locking device.
Figure 2:
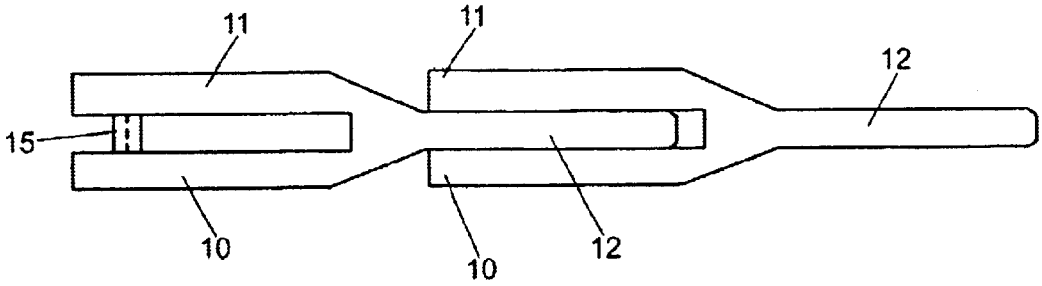
FIG. 2 is a side view of two links in the present locking device.

As shown in the figures, the locking device consists of one chain 1 of links 2, 3, 4 that may be joined together to form a ring. Seen in the plane of the ring, the links 2, 3, 4 in the embodiment illustrated are essentially rectangular, with parallel long sides 5, 6. The ends 7, 8 are preferably rounded as in the enclosed figures.

The ends 7, 8 of the links define a cutout 9 adapted to match the thickness of the shaft of a golf club. Preferably, the innermost portion of the cutout 9 is semicircular, where the diameter of the semicircle is matched to the diameter of the shaft 20 of the golf club and with a wider opening out of the link.

Viewed at right angles to the plane of the ring, each link 2, 3, 4 is forked, so as to consist of two arms 10, 11 at one end and one arm 12 at the other end. The spacing between the arms 10, 11 is matched to the thickness of the arm 12, so as to allow the arm 12 to be inserted between the arms 10, 11 and the links to be rotated relative to each other in the plane of the ring.

In the preferred embodiment of the present locking device 1 shown, the links are joined in a manner such that the links rotate about an imaginary axis 22 that essentially coincides with the center of the semicircular portion of the cutout 9. Thus the axis 22 is also essentially coincident with the longitudinal axis of a golf club placed in the cutout 9. This is achieved by grooves in the shape of sectors of circles 17, 18 being formed in the links 2, 3, 4, the center of which grooves also essentially coincides with the imaginary axis 22. Projections 15, 16 are attached to respective links, and run in the grooves 17, 18 of the adjacent link. This way, the cutouts 9 on the adjacent links form an approximately circular hole that encloses a golf club when the links are in their one mutual position and a groove open to the outside for removal of golf clubs when the links are in their other mutual position.

The locking device for golf clubs according to the present invention is formed by a chain of identical links 2, with an end link 3, 4 at either end. At one end, the end links 3, 4 are connected to a link 2, and at the other end, they have a closed eyelet 21 for fastening a lock upon the two end pieces being brought together. The locking device can have any desired number of links, but will normally be restricted to 14, as this is the maximum number of golf clubs allowed at the same time.

Figure 3:
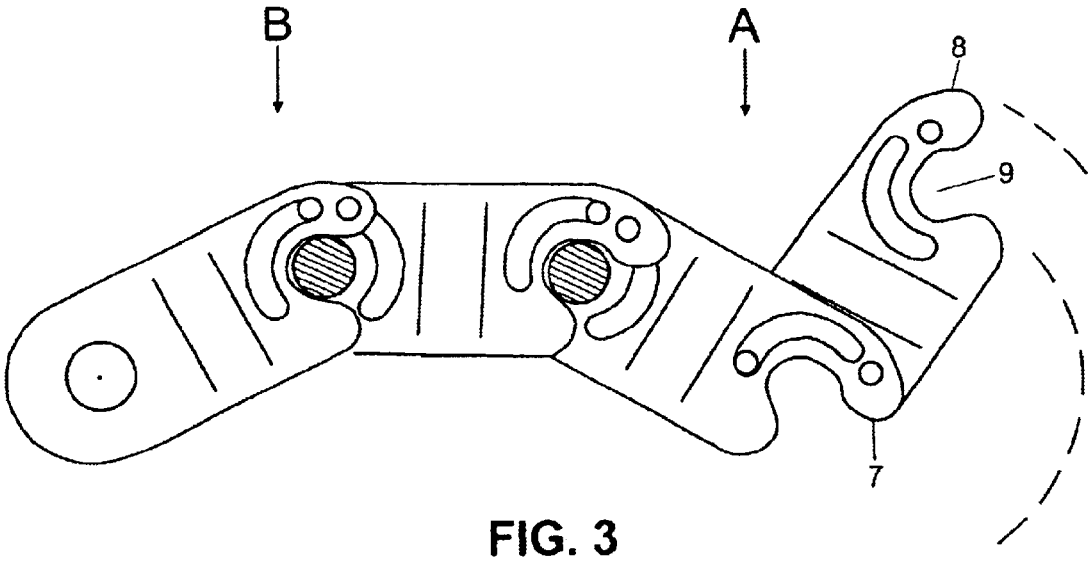
FIG. 3 is a top view of four links in the present locking device in the closed and open positions.

Golf clubs may be placed in the grooves between two links when these are in the "open" position marked "A" in FIG. 3, by the thinnest point of the golf club, the shaft immediately below the head of the club when positioned upside down in the bag, being guided into the cutout 9. The links are then rotated relative to each other to a position marked "B" in FIG. 3. When all the clubs to be locked in have been placed in the device in this manner, a lock such as a pad lock may be inserted through the eyelet 21 of both end links 3, 4 to make the locking device form a closed circle.

Figure 4:
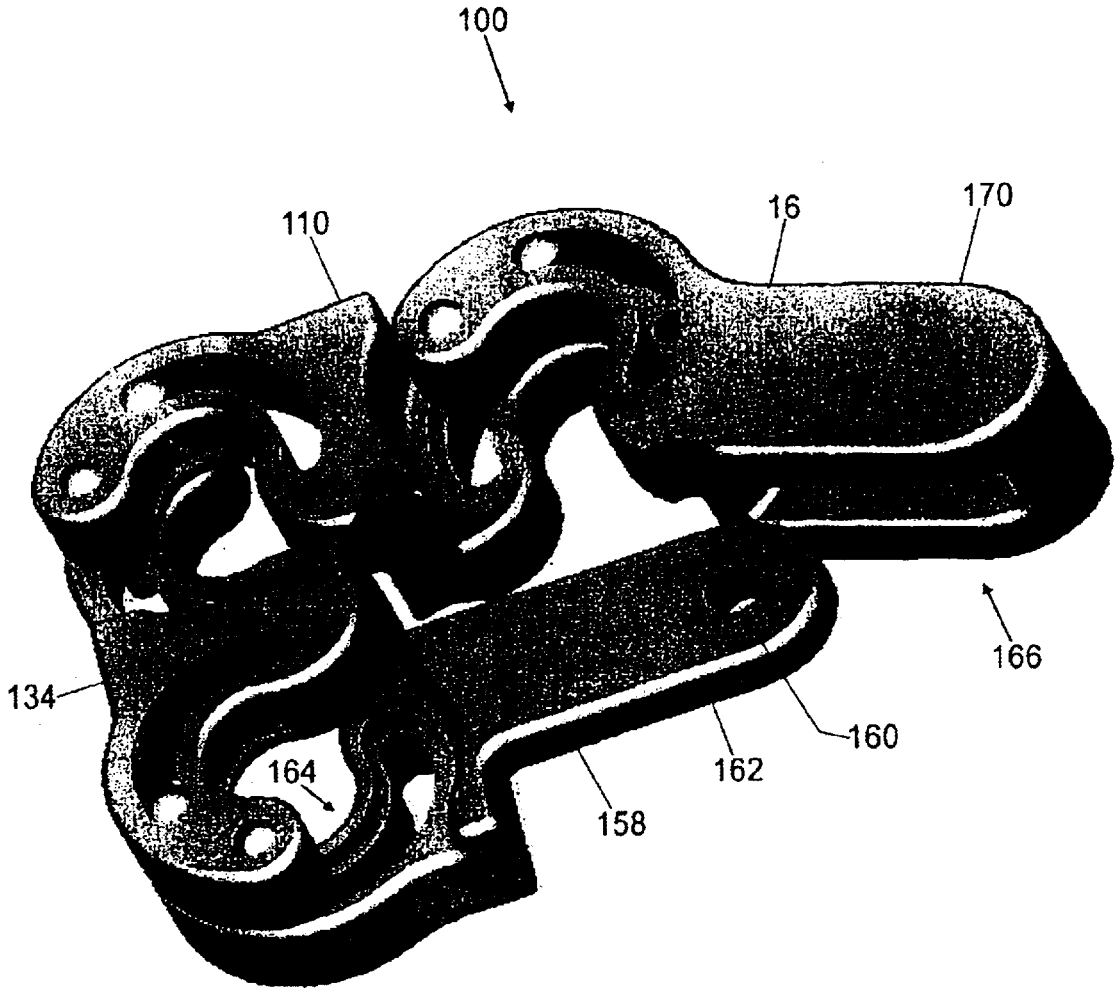
FIG. 4 is a perspective view of another exemplary embodiment of the present locking device.
Figure 5:
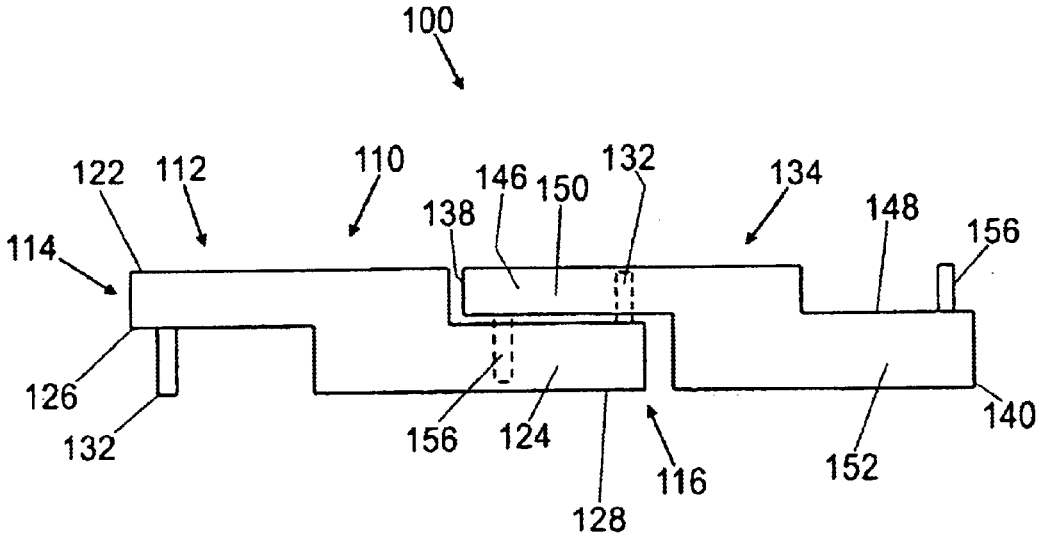
FIG. 5 is a side view of another exemplary embodiment of the present locking device.
Figure 6:
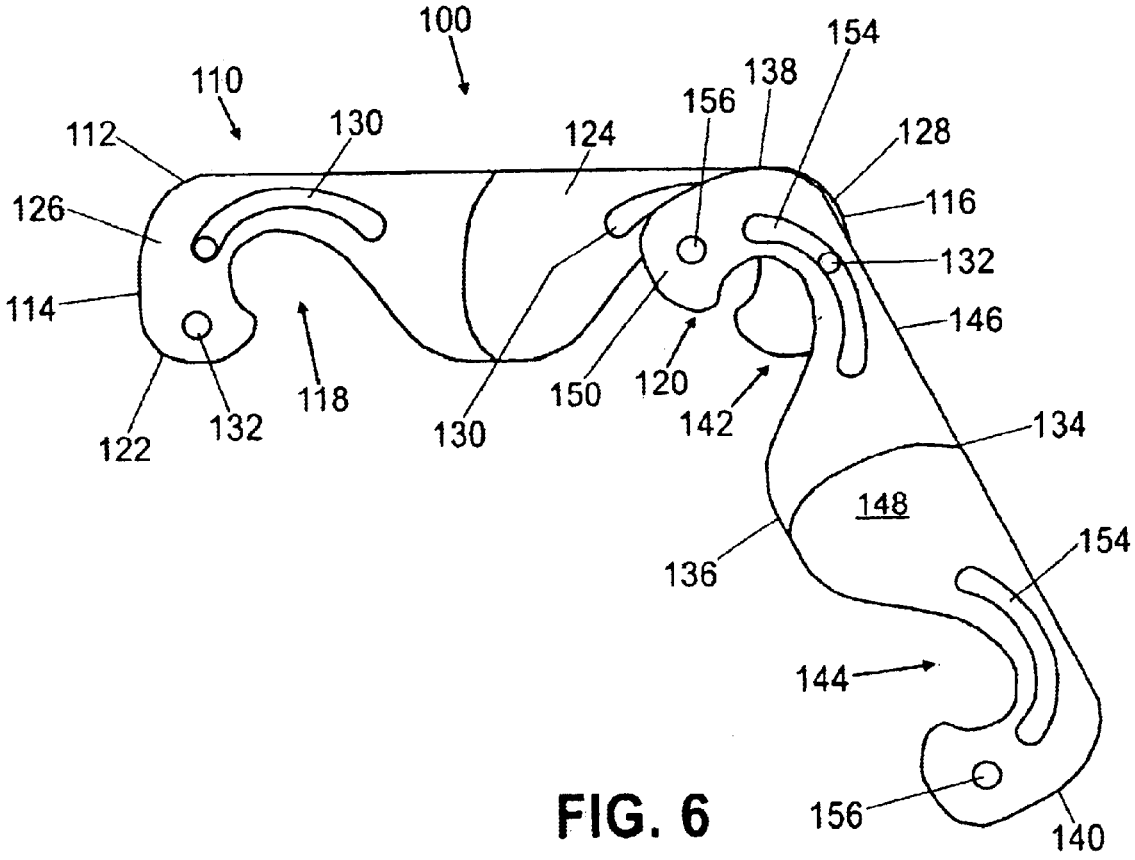
FIG. 6 is a top view of another exemplary embodiment of the present locking device.

Referring to FIGS. 4, 5 and 6, exemplary embodiments of the present locking device are illustrated in perspective, side view and top views respectively. The locking device 100 includes a first link 110 including a body 112 having a front 114 and a rear 116 opposite the front 114. The body 112 defines a first link front cutout 118 having a semicircular pattern configured to match a golf club shaft (not shown) and a first link rear cutout 120 having a semicircular pattern configured to match the golf club shaft. The first link body 112 has a first link front flat portion 122 and a first link rear flat portion 124 opposite the first link front flat portion 122. The first link front flat portion 122 is formed by a first arm 126 proximate the front 114. The first link rear flat portion 124 is formed by a second arm 128 proximate the rear 116. The first link front flat portion 122 and the first link rear flat portion 124 are non-planar. The first link front flat portion 122 lies in a plane that is non-planar with a plane that the first link rear flat portion lies in. The first link 110 includes a pair of first link grooves 130 formed in the first link body 112 proximate the first link front cutout 118 and the first link rear cutout 120 respectively. The first link 110 includes a set of first link projections 132 proximate the front 114 and the rear 116. The locking device 100 includes at least a second link 134 including a body 136 having a front 138 and a rear 140 opposite the front 138. The body 136 defines a second link front cutout 142 having a semicircular pattern configured to match the golf club shaft and a second link rear cutout 144 having a semicircular pattern configured to match the golf club shaft. The second link body 136 has a second link front flat portion 146 and a second link rear flat portion 148. The second link front flat portion 146 is formed by a first arm 150 proximate the front 138. The second link rear flat portion 148 is formed by a second arm 152 proximate the rear 140. The second link front flat portion 146 and the second link rear flat portion 148 are non-planar. The second link 134 includes a pair of second link grooves 154 formed in the second link body 136 proximate the second link front cutout 142 and the second link rear cutout 144. The second link 134 includes a set of second link projections 156 proximate the front 138 and the rear 140. The first link 110 and the second link 134 are configured to enclose the golf shaft between the first link rear cutout 120 and the second link front cutout 142. The second link front flat portion 146 is configured to couple with the first link rear flat portion 124. A first link rear projection 132 is configured to slidably dispose in a second link front groove 154. A second link front projection 156 is configured to slidably dispose in a first link rear groove 130.

In an exemplary embodiment, an additional link 158 comprises an eyelet 160 disposed in an arm 162 opposite a cutout 164. Another additional link 166 includes a link cavity 168 formed in an arm 170 configured to receive the arm 162. The arm 162 is inserted through the link cavity 166 such that the eyelet 160 is exposed. The eyelet 160 is configured to receive a bolt of a padlock (not shown). A chain of links is formed and locked together as a result.

The lock used to lock up the locking device may be a pad lock. The lock may optionally be attached to the bag by means of e.g. a wire, chain or similar, so as to lock the locking device to the bag. A wire, chain and the like may also be used to lock the bag and the locking device to a fixture for locking of golf bags.

The preferred embodiment of the present locking device described allows opening and closing of the cutout by the links 2, 3, 4 being rotated relative to each other. This can also be achieved by use of other hinged mechanisms that are also covered by the enclosed claims. A hinged mechanism that rotates about a physical axle will however cause the diameter of the hole in which the shaft of the golf club is placed to change with the rotation of the links. This is detrimental, as the shaft of the golf club is made from relatively thin-walled tubes that may easily be damaged by pressure. It is clear however, that this problem may be overcome by using stops that prevent the links from rotating through more than a predetermined angle. By use of the present hinged mechanism, the diameter of the hole enclosing the shaft of the golf club is not changed. The hole formed by the cutouts 9 may therefore have a diameter closely matched to the diameter of the shaft, allowing the clubs to be held without being squeezed. Furthermore, the cutout 9 may be lined with materials that provide further retention of the shafts, which may be desirable in order to prevent the clubs from bumping into each other.

The hinged mechanism that enables the links to be rotated relative to each other without squeezing the shafts of the golf clubs may be realised in other ways than described herein. As an example, the grooves 17, 18 need not be through-going. They may be formed e.g. through pressing, casting or milling that surface which faces the adjacent link. Correspondingly, the projections 15, 16 may be projections that simply project from the material, not inserted projections.

The present locking device may be made from various materials. The purpose of the device is to reduce and possibly prevent theft of clubs and maybe entire golf bags. Even though the lock may not be solid enough to prevent the theft, it may prevent the thief from leaving with the goods unnoticed. This may be sufficient to reduce the problem of theft considerably. Thus the lock may be made from plastic materials, although metals, preferably light alloys, are preferable. However the choice of material is not limiting to the invention.

While embodiments and applications of this disclosure have been shown and described, it would be apparent to those skilled in the art that many more modifications than mentioned above are possible without departing from the inventive concepts herein. The disclosure, therefore, is not to be restricted except in the spirit of the appended claims.

What is claimed is:

1. A locking device for locking golf clubs in a golf bag comprising:

a first link including a body having a front and a rear opposite said front, said body defining a first link front cutout having a semicircular pattern configured to match a golf club shaft and a first link rear cutout having a semicircular pattern configured to match said golf club shaft, said first link body having a first link forked portion and a first link flat portion, said first link flat portion formed by a first arm proximate said front, said first link forked portion having a second arm and a third arm opposite said second arm forming a first link spacing proximate said rear, said first link including a pair of first link grooves formed in said first link body proximate said first link front cutout and said rear cutout, said first link including a set of first link projections proximate said front and said rear; and a second link including a body having a front and a rear opposite said front, said body defining a second link front cutout having a semicircular pattern configured to match said golf club shaft and a second link rear cutout having a semicircular pattern configured to match said golf club shaft, said second link body having a second link forked portion and a second link flat portion, said second link flat portion formed by a first arm proximate said front, said second link forked portion having a second arm and a third arm opposite said second arm forming a second link spacing proximate said rear, said second link including a pair of second link grooves formed in said second link body proximate said second link front cutout and said rear cutout, said second link including a set of second link projections proximate said front and said rear; wherein said first link and said second link are configured to enclose said golf shaft between said first link rear cutout and said second link front cutout, said second link flat portion configured to insert into said first link spacing and a first link rear projection configured to slidably dispose in a second link front groove, and a second link front projection configured to slidably dispose in a first link rear groove; and at least a third link including a body having a front and a rear opposite said front, said body defining a third link front cutout having a semicircular pattern configured to match said golf club shaft and a third link rear cutout having a semicircular pattern configured to match said golf club shaft, said third link body having a third link forked portion and a third link flat portion, said third link flat portion formed by a first arm proximate said front, said third link forked portion having a second arm and a third arm opposite said second arm forming a third link spacing proximate said rear, said third link including a pair of third link grooves formed in said third link body proximate said third link front cutout and said rear cutout, said third link including a set of third link projections proximate said front and said rear; wherein said third link and said second link are configured to enclose another golf shaft between said second link rear cutout and said third link front cutout, said third link flat portion configured to insert into said second link spacing and a second link rear projection configured to slidably dispose in a third link front groove, and a third link front projection configured to slidably dispose in a second link rear groove.

2. The locking device of claim 1 wherein said first link and said second link are joined and configured to rotate about an axis centered about a central axis formed by said first link rear cutout and said second link front cutout, said central axis being coincident with a longitudinal axis of said golf club.

3. The locking device of claim 1 wherein said first link and said second link are configured to rotatably align to encircle said golf club and rotatably align to allow for one of removal of said golf club and insertion of said golf club.

4. The locking device of claim 1 wherein a plurality of links are configured to form chain of links that are configured to releasably lock a plurality of golf clubs around each shaft of said plurality of golf clubs.

5. The locking device of claim 4 wherein an additional link comprises an eyelet opposite a cutout, wherein said eyelet is configured to overlap with another eyelet and configured to receive a bolt of a padlock, wherein said chain of links is formed and locked together.

6. The locking device of claim 5 wherein said chain of links is coupled to a golf bag.

7. The locking device of claim 1 wherein said first link and said second link include stops coupled to said set of grooves, said stops configured to encircle said golf club at a predetermined size to prevent damage to said golf club shaft.

8. The locking device of claim 1 wherein said first link cutout and said second link cutout are lined with a material configured to retain said golf club shaft.

9. A locking device for locking golf clubs in a golf bag comprising:

a first link including a body having a front and a rear opposite said front, said body defining a first link front cutout having a semicircular pattern configured to match a golf club shaft and a first link rear cutout having a semicircular pattern configured to match said golf club shaft, said first link body having a first link front flat portion and a first link rear flat portion, said first link front flat portion formed by a first arm proximate said front, said first link rear flat portion formed by a second arm proximate said rear, said first link front flat portion and said first link rear flat portion being non-planar, said first link including a pair of first link grooves formed in said first link body proximate said first link front cutout and said first link rear cutout, said first link including a set of first link projections proximate said front and said rear; and a second link including a body having a front and a rear opposite said front, said body defining a second link front cutout having a semicircular pattern configured to match a golf club shaft and a second link rear cutout having a semicircular pattern configured to match said golf club shaft, said second link body having a second link front flat portion and a second link rear flat portion, said second link front flat portion formed by a first arm proximate said front, said second link rear flat portion formed by a second arm proximate said rear, said second link front flat portion and second first link rear flat portion being non-planar, said second link including a pair of second link grooves formed in said second link body proximate said second link front cutout and said second link rear cutout, said second link including a set of second link projections proximate said front and said rear, wherein said first link and said second link are configured to enclose said golf shaft between said first link rear cutout and said second link front cutout, said second link front flat portion configured to couple with said first link rear flat portion and a first link rear projection configured to slidably dispose in a second link front groove, and a second link front projection configured to slidably dispose in a first link rear groove.

10. The locking device of claim 9 wherein said first link and said second link are configured to be coupled repeatable as a plurality of links.

11. The locking device of claim 9 wherein said first link and said second link are joined and configured to rotate about an axis centered about a central axis formed by said first link rear cutout and said second link front cutout, said central axis being coincident with a longitudinal axis of said golf club.

12. A The locking device of claim 9 wherein said first link and said second link are configured to rotatably align to encircle said golf club and rotatably align to allow for one of removal of said golf club and insertion of said golf club.

13. The locking device of claim 9 wherein a plurality of links are configured to form a chain of links that are configured to releasably lock a plurality of golf clubs around each shaft of said plurality of golf clubs.

14. The locking device of claim 13 wherein an additional link comprises an eyelet opposite a cutout, wherein said eyelet is configured to insert into a link cavity and configured to receive a bolt of a padlock, wherein said chain of links is formed and locked together.

15. The locking device of claim 14 wherein said chain of links is coupled to a golf bag.

16. The locking device of claim 9 wherein said first link and said second link include stops coupled to said set of grooves, said stops configured to encircle said golf club at a predetermined size to prevent damage to said golf club shaft.

17. The locking device of claim 9 wherein said first link cutout and said second link cutout are lined with a material configured to retain said golf club shaft.

* * * * *